US005222401A

United States Patent [19]

Fasola et al.

[11] Patent Number: 5,222,401

[45] Date of Patent: Jun. 29, 1993

[54] STARTER FOR AN INTERNAL COMBUSTION ENGINE FOR MOTOR VEHICLES

[75] Inventors: Giancarlo Fasola, Milan; Giovanni Cerizza, Lido, both of Italy

[73] Assignee: Industrie Magneti Marelli SpA, Milan, Italy

[21] Appl. No.: 903,214

[22] Filed: Jun. 23, 1992

[30] Foreign Application Priority Data

Jun. 25, 1991 [IT] Italy ..... 91 A000485

[51] Int. Cl.[5] ..... F02N 15/06

[52] U.S. Cl. ..... 74/7 A; 335/131

[58] Field of Search ..... 74/6, 7 R, 7 A; 335/131

[56] References Cited

U.S. PATENT DOCUMENTS

| | | | |
|---|---|---|---|
| 2,482,534 | 9/1949 | Antonidis | 74/7 A |
| 3,177,728 | 4/1965 | Farison | 74/7 |
| 4,635,489 | 1/1987 | Imamura et al. | 74/7 A X |
| 5,016,484 | 5/1991 | Morikane | 74/7 A X |
| 5,038,626 | 8/1991 | Morishita et al. | 74/7 A X |

FOREIGN PATENT DOCUMENTS

| | | | |
|---|---|---|---|
| 2587760 | 3/1987 | France . | |
| 59-122778 | 7/1984 | Japan | 74/7 A |
| 2120461 | 11/1983 | United Kingdom | 74/7 A |
| 2180889 | 4/1987 | United Kingdom . | |

*Primary Examiner*—Allan D. Herrmann
*Assistant Examiner*—David W. Laub
*Attorney, Agent, or Firm*—Kenyon & Kenyon

[57] ABSTRACT

The starter includes a movable pinion and a control electromagnet. A transmission between the core of the electromagnet and the pinion includes a rocker lever. The lever has a shaped profile so that the initial loadless travel of the core is shorter than would be the case with a substantially straight lever, if other geometrical conditions remain the same.

3 Claims, 6 Drawing Sheets

$X_N - X_G$
4
3
2
1
0
-1
W
$t_0$
0
1
T
+

$X_G$
$(\sim X_P)$
4
3
2
1
0
-1
$t_0$
0
1
=

$X_N$
4
3
2
1
0
-1
$t_0$
0
1

STARTER FOR AN INTERNAL COMBUSTION ENGINE FOR MOTOR VEHICLES

BACKGROUND OF THE INVENTION

The present invention relates to a starter for an internal combustion engine for a motor vehicle.

More specifically, the invention relates to a starter of the type including:

a movable pinion which is adapted to mesh with a gear of the internal combustion engine, a control electromagnet including a core which is movable between a rest position and an actuating position and has an entrainment appendage at its end, a transmission between the core of the electromagnet and the pinion, the transmission including a rocker lever with a first end connected to a movable member for moving the pinion and a second end which is connected, with play, to the appendage of the core of the electromagnet so that, when the electromagnet is excited, the core leaves its rest position and travels an initial distance without a load before the appendage pivots the lever, and an electric motor which can be supplied so as to rotate the pinion when the movable core of the electromagnet has reached the actuation position and closes an electrical switch.

A starter of this type is described, for example, in French patent FR-B-2,587,760.

In starters of this type, the pinion must already be meshed with the ring gear of the internal combustion engine when the core of the electromagnet reaches the actuation position and the electric motor is supplied. This is necessary in order to prevent harmful slippage and consequent damage to the teeth of the pinon and of the ring gear when the motor is started.

The transmission between the core of the electromagnet and the pinion is not generally rigid. In fact, there is play in the connection between the rocker lever and the entrainment appendage of the electromagnet. The play is for preventing the pinion from accidentally being moved towards and against the ring gear of the internal combustion engine as a result of vibrations and jolting of the motor vehicle whilst the internal combustion engine is in operation and the starter is at rest.

As stated above, the transmission between the core of the electromagnet and the pinion is not rigid and may include one or more springs, for example, for facilitating the meshing between the pinion and the ring gear of the internal combustion engine in the event of frontal sticking. Moreover, the rocker lever itself is often resiliently flexible.

As a result of the play between the entrainment appendage of the core of the electromagnet and the rocker lever at rest, and of the fact that the transmission as a whole is not rigid, the movement of the pinion is not exactly proportional to that of the core. The pinion is not therefore always certain to be meshed adequately with the ring gear of the internal combustion engine when the core reaches the actuation position and the electric motor is supplied.

An object of the present invention is therefore to provide a starter of the aforesaid type which can reduce or prevent the problem described above.

SUMMARY OF THE INVENTION

According to the invention, this object is achieved by means of a starter of the type specified above, the main characteristic of which lies in the fact that the rocker lever has a shaped profile so that, if other conditions remain the same, its initial loadless travel is shorter than would be the case with a substantially straight lever. In one embodiment, the second end of the rocker lever is inclined towards the entrainment member of the core.

The invention thus reduces the play between the entrainment appendage of the core of the electromagnet and the rocker arm at rest in an extremely simple manner. As will become clearer from the following, this reduces the likelihood of the pinion not yet being adequately meshed with the teeth of the ring gear of the internal combustion engine when the electric motor is supplied.

In addition to this advantage, the solution according to the invention also reduces the likelihood of the movable member of the switch associated with the electromagnet for controlling the supply to the electric motor bouncing on the associated fixed contacts. This reduces the likelihood of arcing and damage to the switch which, as is known, may even lead to so-called "sticking" of the movable contact to the fixed contacts.

Further characteristics and advantages of the invention will become clear from the detailed description which follows, with reference to the appended drawings, provided purely by way of a non-limiting example

DETAILED DESCRIPTION

Figure 1:
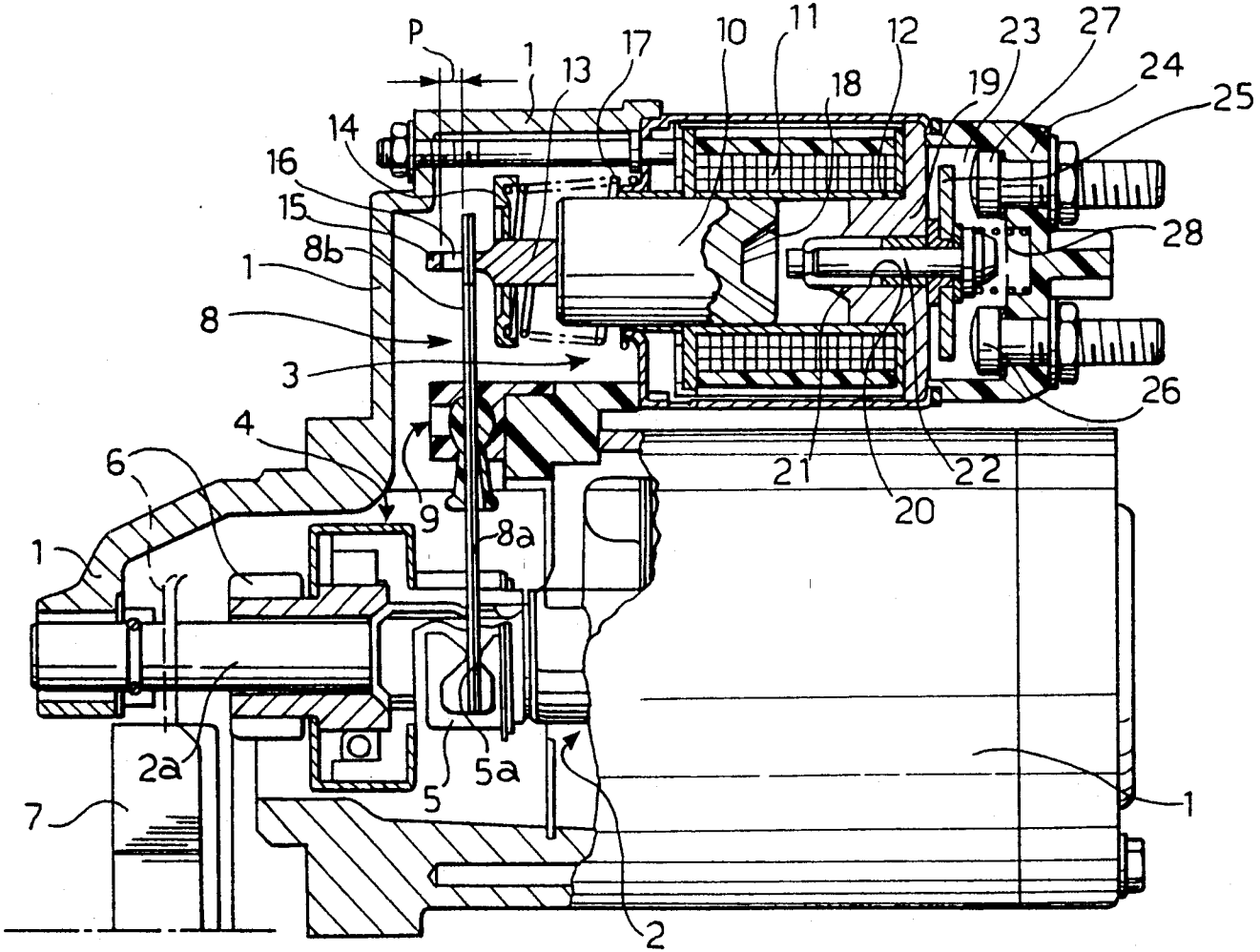
FIG. 1 is a partially-sectioned side view of a known starter.

With reference to FIG. 1, a starter for an internal combustion engine for motor vehicles includes a support casing 1 in which an electric drive motor 2 and an electromagnet 3 are mounted in a known arrangement. In the arrangement shown, an overrunning (free-wheel) coupling is mounted on the shaft of the electric motor 2. A sleeve 5 is movable with the coupling 4 on the shaft of the motor 2. A pinion 6 is connected on the opposite of the coupling 4 from the motor 2 and is movable axially along a smooth end portion 2*a* of the shaft of the electric motor 2. In particular, the pinion 6 can move between a retracted rest position, shown in continuous outline in FIG. 1, and a forward working position, shown in broken outline, in which it can mesh with the teeth of a flywheel 7 of the internal combustion engine (not shown).

A rocker lever, indicated 8, rotatable about a fulcrum 9, acts as a transmission member between the sleeve 5, which moves the pinion 6, and the core of the electromagnet 3.

In the embodiment illustrated, the lever 8 is of the leaf-spring type and includes two substantially Y-shaped metal plates joined together, their lower ends 8*a* forming two prongs which engage suitable seats 5*a* on the sides of the sleeve 5. The other end of the lever 8, which is indicated 8*b*, is connected to the movable core of the electromagnet 3 in the manner which will now be described.

The electromagnet 3 includes a movable core 10 which is movable axially within a control winding or solenoid 11 carried by a bobbin 12.

One end of the core 10 has an axial extension 13 around which a plate 14 is fixed. The extension 13 of the core 10 has an entertainment appendage 15 with a slot 16 through which the end 8*b* of the rocker lever 8 extends. A helical spring 17, which reacts against the plate 14, tends to keep the core 10 in the position shown, in which it extends partially out of the control winding or solenoid 11 and in which the upper end 8*b* of the lever 8 bears against the right-hand end (as seen in the drawing) of the slot 16. The end of the lever is thus spaced from the left-hand end (again as seen in the drawing) of the slot, by a distance indicated P. This distance will be defined below as the play at rest.

The core 10 has a frustoconical recess 18 in its end opposite that with the extension 13.

A fixed core, generally indicated 19, is inserted in the end of the bobbin 12 of the electromagnet which faces away from the lever 8. The fixed core has a duct 20 coaxial with the bobbin 12 and the core 10. One end of the duct opens in the center of a frustoconical projection 21 of the fixed core 19, facing and complementary in shape to the recess 18 in the movable core 10.

A rod 22, movable axially in the duct 20, has an end which extends into a region 23 defined between the fixed core 19 of the electromagnet and a substantially cup-shaped insulating body 24. This end of the rod 22 carries a contact member (the movable contact}25 which can cooperate with a pair of fixed contacts 26 and 27 carried by the end wall of the insulating element 24. In the embodiment illustrated, the fixed contacts 26 and 27 are formed by screws. In the rest condition, a spring 28 between the insulating body 24 and the end head of the rod 22 keeps the latter in the position shown, in which its other end extends beyond the projection 32 of the fixed core 19 towards the movable core 10. In this condition, the movable contact 25 is separated from the fixed contacts 26 and 27. The movable contact and the associated fixed contacts together constitute an electrical switch which controls the supply of current to the electric motor 2 (in known manner). The switch closes when the movable core 10 moves towards the fixed core 19 as a result of the excitation of the control solenoid 11 and, during the last part of its travel, moves the rod 22 and the associated movable contact 25 towards the fixed contacts 26, and 27.

In the starter according to the prior art described above with reference to FIG. 1, the positions of the movable core 10 and the rocker lever 8 change, in operation, in the manner shown schematically in FIG.s 2*a* to 2*d*.

Figure 2A:
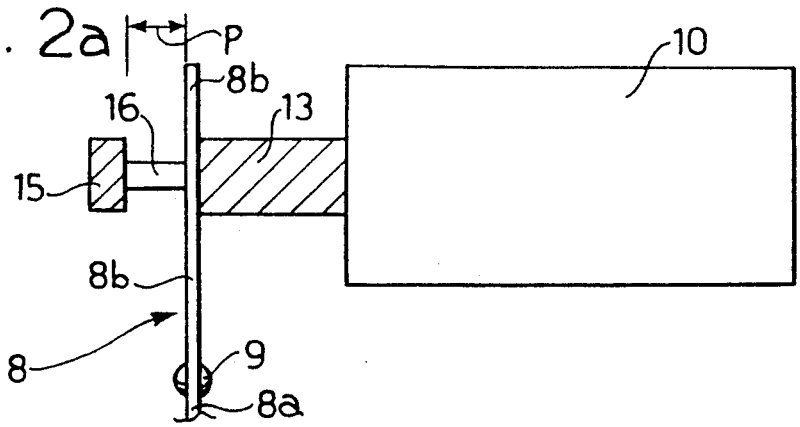
FIGS. 2*a* to 2*d* are schematic representations of the movable core of an electromagnet in the starter of FIG. 1 and of an associated rocker lever in four different operative positions.

In FIG. 2*a*, the movable core 10 and the lever 8 are shown in the rest condition corresponding to FIG. 1. In this situation, there is a distance, that is, the play at rest, indicated P, between the end 8*b* of the lever 8 and the entrainment appendage 15 of the core 10.

When the control solenoid 11 of the electromagnet 3 is supplied with an excitation current, the core 10 is subjected to a force which moves it towards the fixed core 19 and hence to the right as seen in FIGS. 1 and 2. The core 10 thus travels a first distance equal to the play at rest P without entraining the rocker lever 8. When it has travelled a distance equal to the play at rest (FIG. 2*b*), the entrainment appendage 15 of the core 10 engages the arm 8*b* of the lever 8 and starts to pivot it (clockwise as seen in FIG. 2) about its fulcrum 9. The lever 8 correspondingly moves the pinion 6 towards the ring gear 7 of the internal combustion engine.

The core 10 continues to move and abuts the end of the rod 22 which carries the movable contact 25. The core 10 continues its travel, pivoting the lever 8 further and urging the rod 22 and the associated movable contact 25 towards the fixed contacts 26 and 27.

Figure 2B:
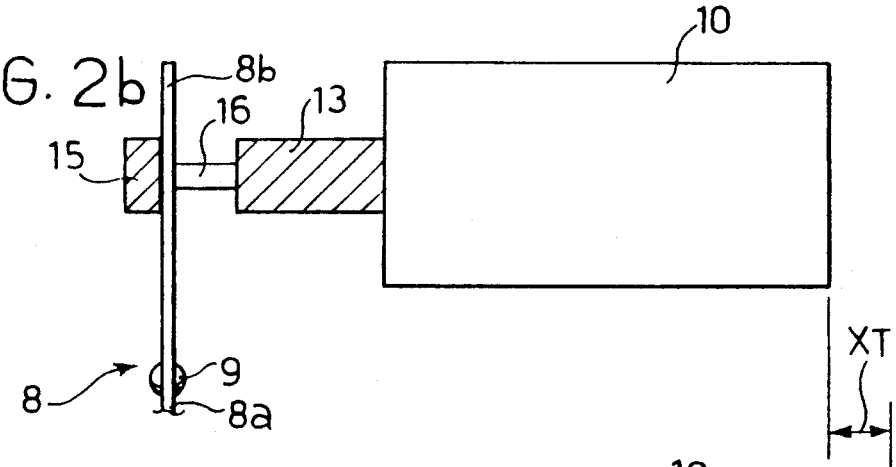
Figure 2C:
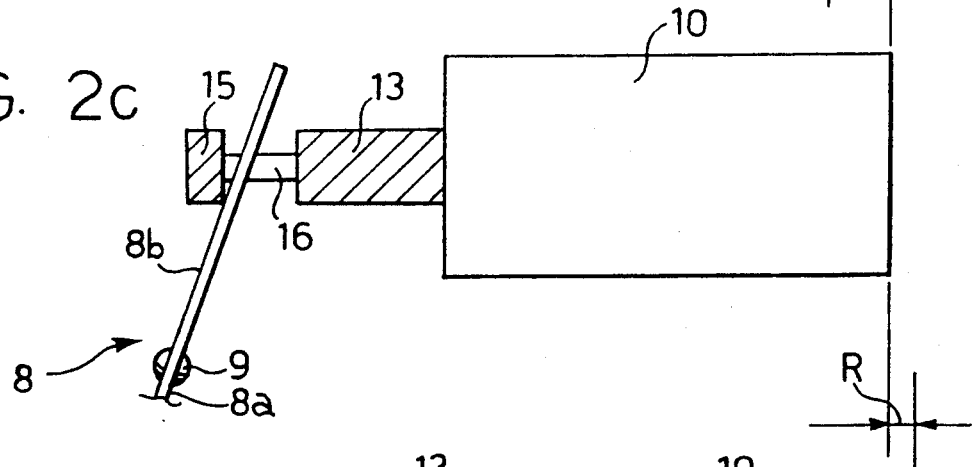

FIG. 2*c* shows the relative positions of the lever 8 and the core 10 when the movable contact reaches the fixed contacts 26 and 27.

Figure 2D:
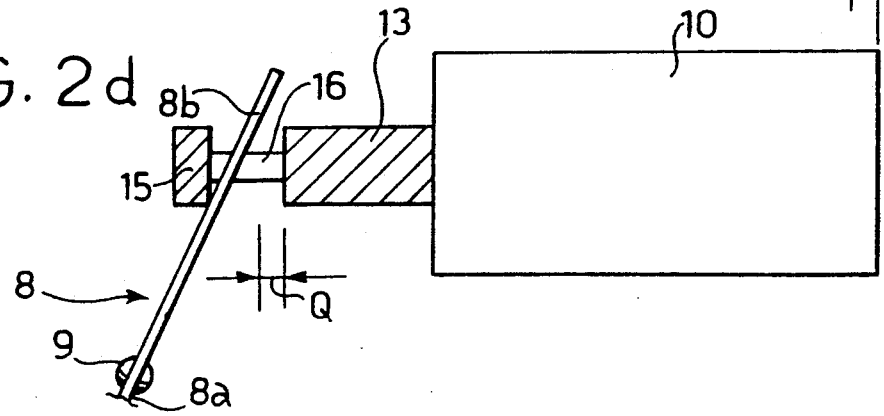

The core 10 stops moving when it abuts the fixed core 19 (the position shown in FIG. 2*d*). In this condition there is conveniently a distance, indicated Q in FIG. 2*d*, between the arm 8*b* of the rocker lever 8 and the right-hand end of the slot 16 in the appendage 13 of the core.

In the condition of FIG. 2*c*, the movable contact 25 is disposed against the fixed contacts 26 and 27 and thus causes current to be supplied to the electric motor 2. In this condition, the pinion 6 should preferably already have engaged the teeth of the ring gear of the flywheel 7 of the internal combustion engine.

For a better understanding of the dynamics of the movement of the pinion, the rocker lever, and the movable core of the electromagnet and the effect which the extent of the play at rest P has on those dynamics, some theoretical considerations will be explained below with reference to FIGS. 3 and 4 of the appended drawings.

Figure 3:
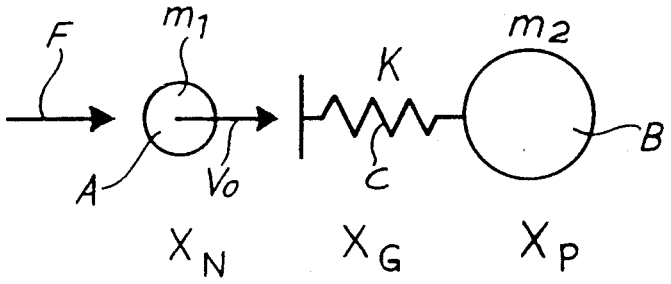
FIG. 3 is a simplified kinematic diagram corresponding to the part of a starter which includes the pinion, the core of the electromagnet, and the transmission interposed between them.

From the point of view of its kinematics/dynamics, the system formed by the pinion 6 (and the attached devices which are moved by the arm 8*a* of the lever 8), the lever 8, the movable core 10 and the spring 17 may be represented diagrammatically as shown in FIG. 3. In this diagram, two bodies, indicated A and B, with respective masses $m_1$ and $m_2$ of which $m_2 >> m_1$, are equivalent to the movable core 10 and the movable device which is moved by the lower arms 8*a* of the rocker lever 8 (the pinion 6, the free-wheel coupling 4 and the sleeve 5).

A spring C with an elastic modulus k, interposed between the two bodies A and B, corresponds to the lever 8. The force, indicated F, acting on the body A thus corresponds to the force exerted by the control solenoid 11 on the movable core 10. Under this force, (the body A moves, with an initial velocity $V_0$, to compress the spring C. If the positions of the centres of mass of the body A, of the body B, and of the system formed by the two bodies and the attached spring C at a particular time are indicated $X_N$, $X_P$ and $X_G$, it can be established, on the basis of the equation of motion for the system of FIG. 3, that the movements of the position $X_N$–$X_G$ (the position of the core relative to the center of mass of the entire system), the position $X_G$ (the position of the center of mass of the entire system), and the position $X_N$ (the position of the center of mass of the core) move, over a period of time, according to the curves shown qualitatively in FIGS. 4*a*, 4*b* and 4*c*, respectively.

In these graphs, the time at which the entrainment appendage 15 of the movable core 10 starts to engage the rocker lever 8 (the position of FIG. 2*b*) is indicated $t_0$.

Figures 4A, 4B, 4C:
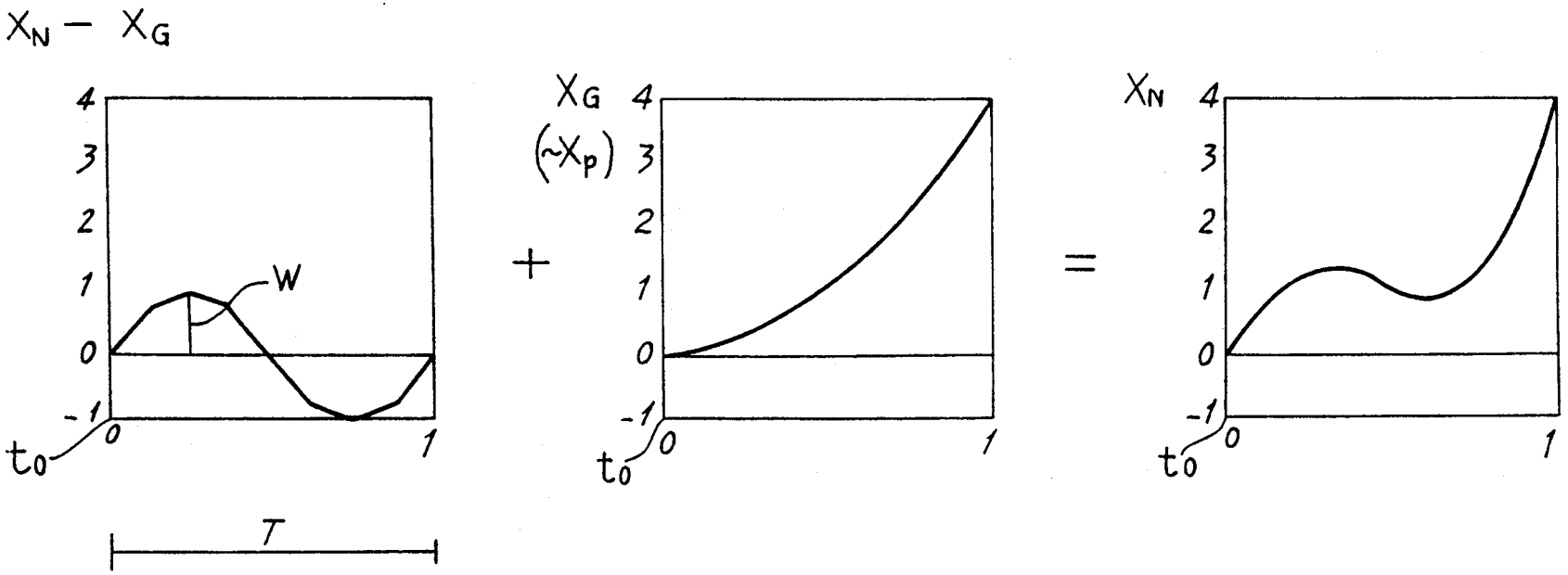
FIGS. 4*a* to 4*c* are three graphs showing the displacement of the pinion relative to the center of mass of the system of FIG. 3, the displacement of the center of mass of the system of FIG. 3, and the displacement of the core, still with reference to the system of FIG. 3, as functions of time which is shown on the abscissa.

FIG. 4*a* indicates that, in practice, the position of the body A, and hence of the movable core 10, relative to the center of mass of the system oscillates about a zero position. The period T of this oscillation can easily be calculated and is given by:

$$T = 2\text{pi} \cdot \sqrt{\frac{m_1 \cdot m_2}{k \cdot (m_1 + m_2)}}$$

The maximum amplitude W of this oscillation is given by: $W = V_0/$ omega, where omega $= 2\text{pi}/T$.

Since, as a rule, $m_2 >> m_1$, $X_P$ is approximately equal to $X_G$.

The motion of the pinion 6 is correspondingly an accelerated motion as indicated clearly by the graph of FIG. 4*b*.

The position $X_N$ the core thus moves according to the curve shown qualitatively in FIG. 4*c*; this curve corresponds to the superposition of the curves shown in FIGS. 4*a* and 4*b* as indicated by the + symbol and the =symbol shown between the FIGS. 4*a* and 4*b* and between the FIGS. 4*b* and 4*c*, respectively.

Figure 5:
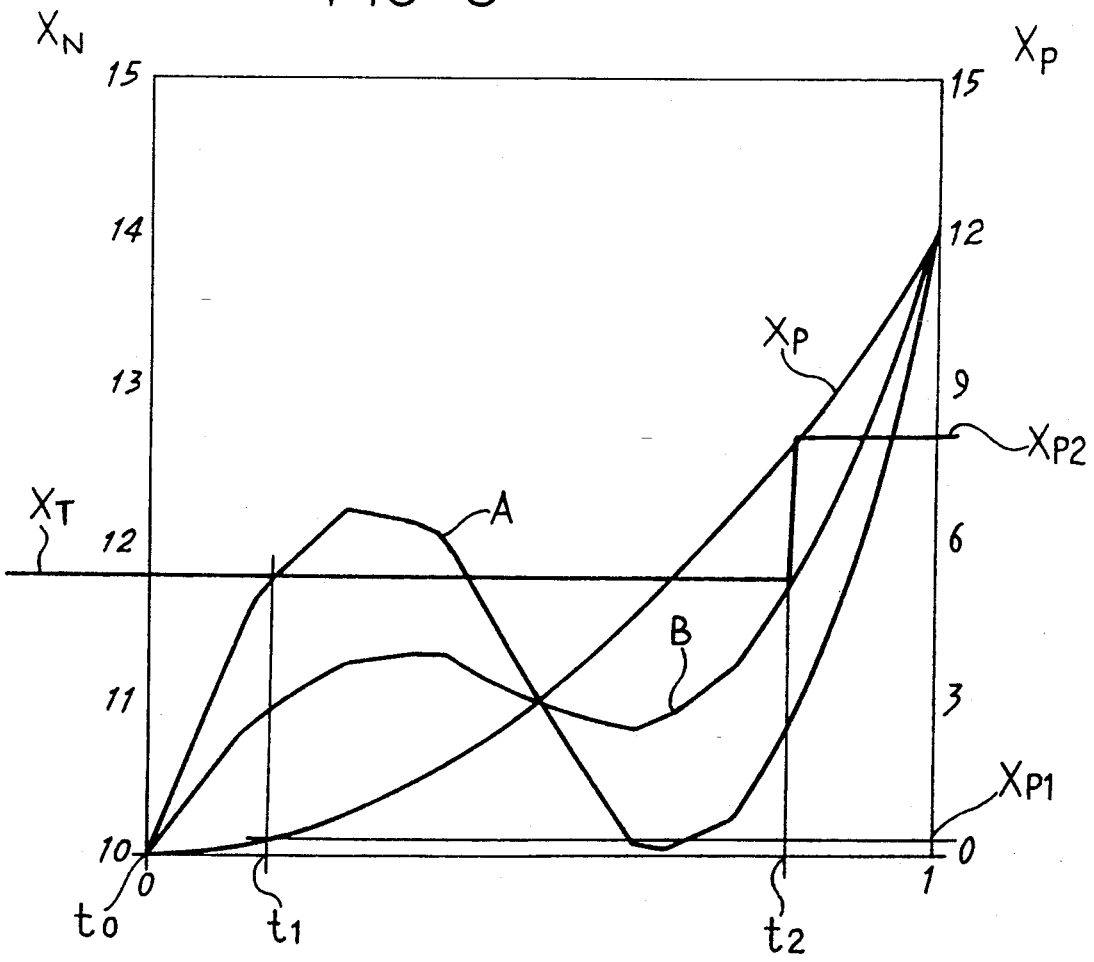
FIG. 5 is a set of graphs showing possible curves of the positions of the core and the pinion in a starter system, as functions of time which is shown on the abscissa.

FIG. 5 shows a curve of the position, indicated $X_P$, of the pinion 6 starting from the time $t_0$, and two curves, indicated A and B of the position $X_N$ of the core 10 of the electromagnet, relating to two different values of the velocity $V_0$ of the core at the time when its entrainment appendage 15 engages the rocker lever 8, as functions of time which is shown on the abscissa. Since this velocity value depends on the extent of the loadless travel of the core, that is, on the play at rest P, the two curves A and B of FIG. 5 in fact relate to two different values of the play at rest. In particular, the curve A corresponds to a greater play at rest than the curve B.

The following observations may be made on the basis of FIG. 5:

the travel of the core 10 of the electromagnet between the position of FIG. 2*b*, in which the movable core 10 starts to engage the lever 8 and the actuation position (FIG. 2*c*) is assumed to have a value $X_T$, indicated by a line parallel to the absicssa in FIG. 5.

If the play at rest P between the entrainment appendage 15 of the core and the rocker arm assumes the value which corresponds to the curve A of FIG. 5, the core 10 reaches the actuation position (after travelling a distance $X_T$) at the time indicated $t_1$ in FIG. 5, at which time the pinion has performed a minimal movement and occupies the position indicated $X_{P1}$ in FIG. 5.

If, however, the play at rest P assumes the value corresponding to the curve B of the FIG. 5, the core of the electromagnet reaches the actuation position, after travelling a distance $X_T$, at the time indicated $t_2$ in FIG. 5. At this time, the pinion 6 has reached the position indicated $X_{P2}$ in FIG. 5.

The foregoing explanation enables the following conclusion to be drawn: the greater the play at rest P, the shorter is the distance travelled by the pinion before the core of the electromagnet reaches the actuation position and causes current to be supplied to the electric starter motor. This corresponds to a greater likelihood of the pinion 6 not yet having succeeded in meshing adequately with the teeth of the ring gear 6 of the internal combustion engine and hence a greater likelihood of slippage and consequent damage to the teeth of the pinion and of the ring gear.

In order to reduce the likelihood of slippage, it is therefore desirable and appropriate for the play at rest P to be shortened.

In a starter of the type described with reference to FIG. 1, this can easily be achieved, according to the invention, by modifying the rocker lever 8, (for example) in the manner shown in FIG. 6. In this drawing, the same reference numerals have again been attributed to parts and elements already described.

Figure 6:
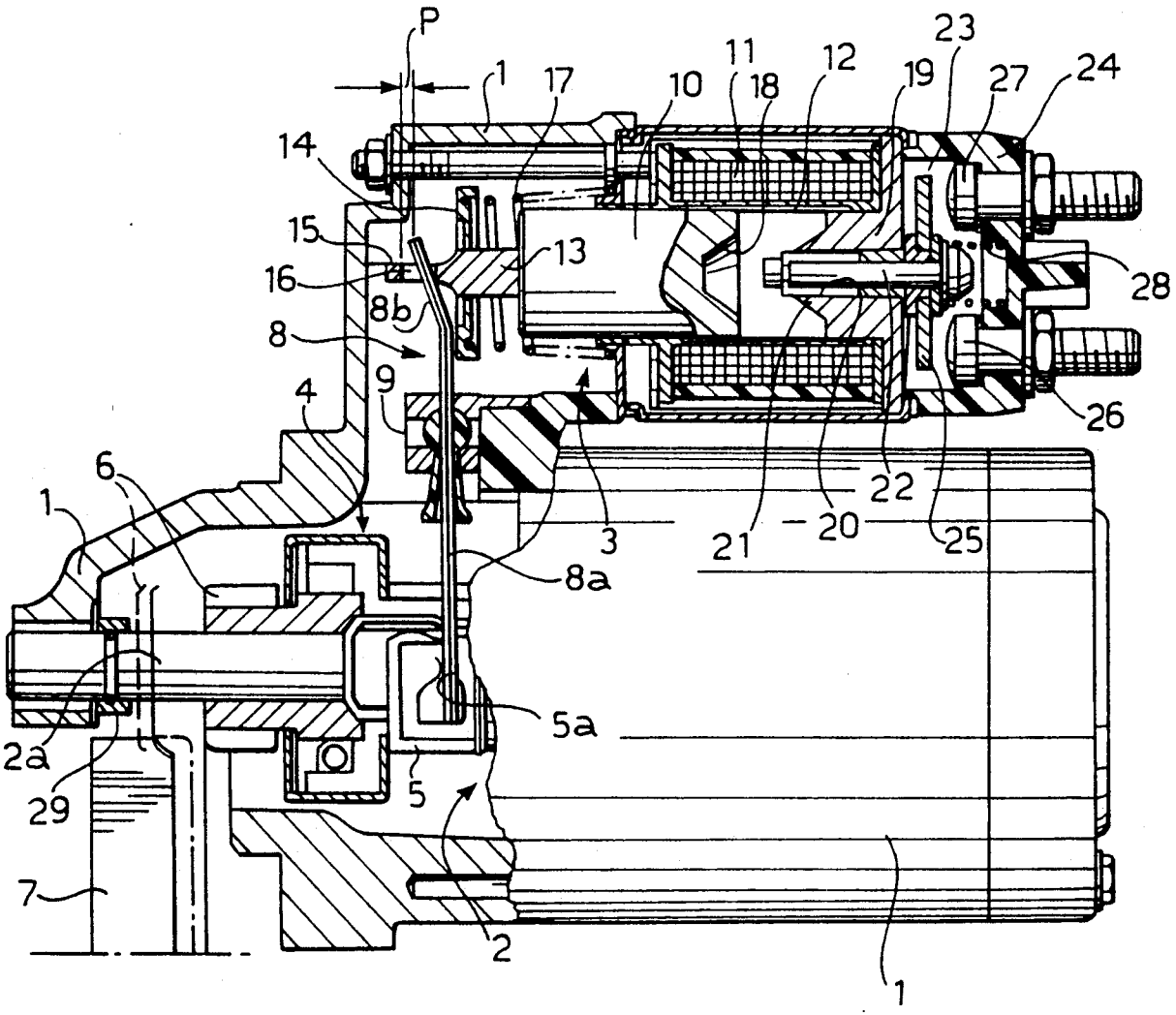
FIG. 6 is a partially-sectioned side view of a starter according to the invention.

As can be seen in FIG. 6, according to the invention, the arm 8*b* of the rocker lever 8 is inclined towards the entrainment appendage 15 of the core 10 of the electromagnet. This can be achieved by the arm being bent, as shown in FIG. 6, or by a progressive curvature of the arm.

Figure 7A:
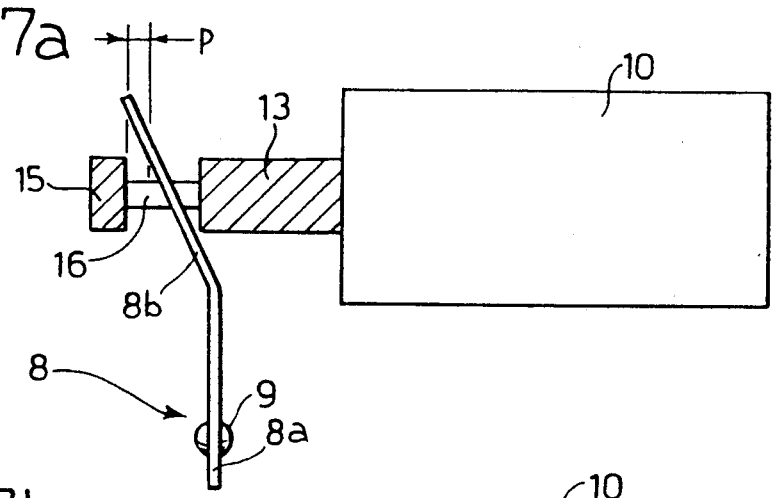
FIGS. 7*a* and 7*d* are views similar to those of FIGS. 2*a* to 2*d* but relating to the starter according to the invention shown in FIG. 6.
Figure 7B:
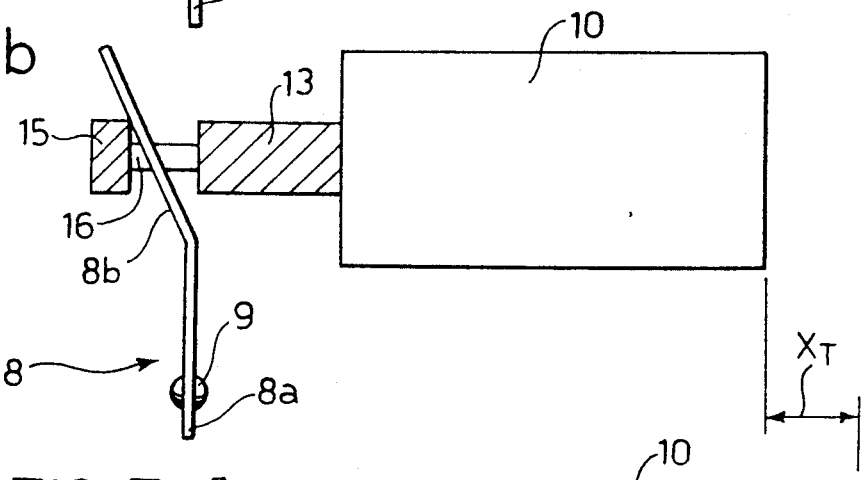
Figure 7C:
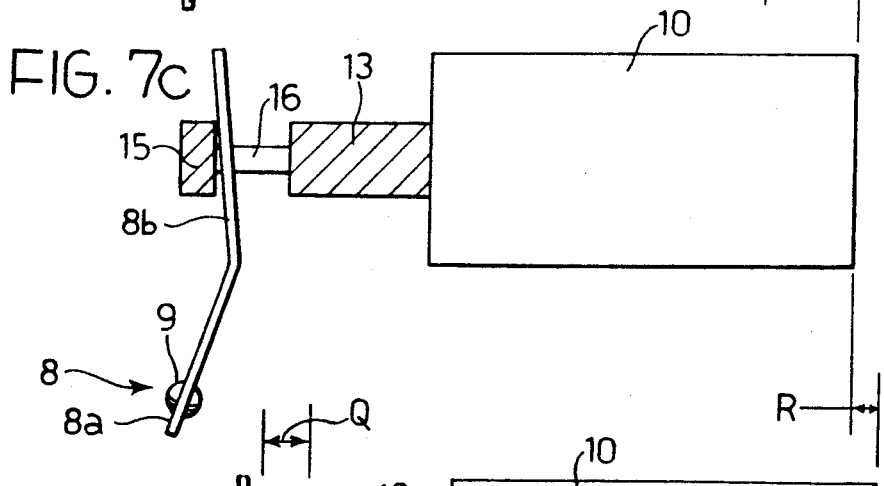

If other geometrical conditions remain the same, the inclination of the upper arm of the rocker lever towards the entrainment appendage of the core of the electromagnet reduces the play at rest P, as can be seen from by a comparison of FIGS. 7*a* and 2*a*.

FIGS. 7*a* to 7*d* show the core of the electromagnet and the rocker lever of the starter of FIG. 6, in the same relative positions as those shown in FIGS. 2*a* to 2*d*.

Figure 7D:
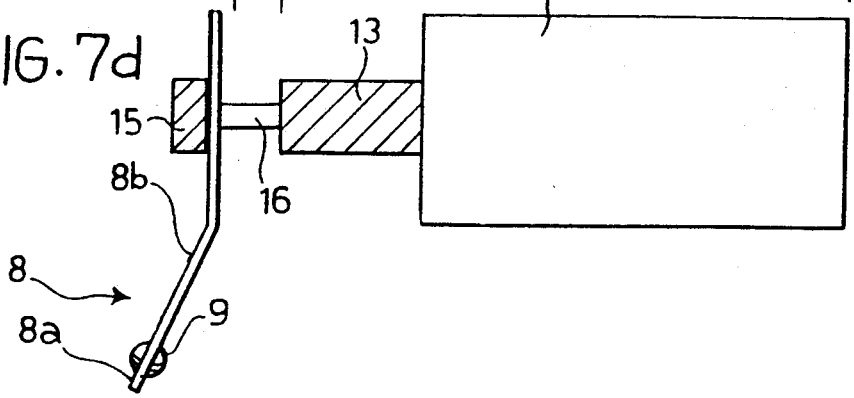

A comparison of FIGS. 2*d* and 7*d* shows that the inclination of the end of the upper arm of the rocker lever means that, in the actuation position, the play Q between the upper arm of the lever 8 and the right-hand end (as seen in the drawings) of the slot 16 in the extension of the core 10 is also greater. This is also particularly advantageous, since, in the position of FIG. 2*d* in which the movable core 10 abuts the fixed core 19, the pinion 6 is meshed with the ring gear 7 to an extent which depends on the travel of the movable core. During starting, the internal combustion engine "sucks" the pinion 6 inwardly of the ring gear 7 until the pinion 6 abuts a stop ring 29; this further travel (which will be defined: N) of the pinion results in further pivoting of the lever 8, the upper end 8*a* of which travels a distance S given by:

$$S = N/T$$

in which T is the lever ratio of the starter motor in question. So that the upper end of the arm 8*a* does not oppose the release of the movable core 10 during the opening of the switch and thus make it difficult for the movable contact 25 to move away from the fixed contacts 26 and 27, the actual play Q when the switch is closed must be:

$$Q \geqq R + S$$

in which R is the overlap travel, that is the distance travelled by the movable core 10 in order to move from the position of FIG. 2*c* (the closure of the contacts and hence the supply of the motor 2) to the position of FIG. 2*d* (in which the movable core 10 abuts the fixed core 19).

In the condition of FIG. 7*d*, the actual play Q when the switch is closed is greater, for a given length of the slot 16 and thickness of the lever, than would be the case if the lever were straight; for given dimensions, the condition $Q \geqq R+S$ can therefore more easily be achieved with the solution according to the invention.

As well as reducing the likelihood of interference or slippage between the teeth of the pinion 6 and of the ring gear 7, the reduction in the play at rest P means that the movable contact 25 strikes the fixed contacts 26 and 27 at a slower speed. The likelihood of the movable contact bouncing on the fixed contacts, or of arcing between the contacts, is therefore correspondingly reduced. Benefits are thus also achieved as regards the life and reliability of the contacts.

Naturally, the principle of the invention remaining the same, the forms of embodiment and details of construction may be varied widely with respect to those described and illustrated purely by way of non-limiting example, without thereby departing from the scope of the present invention. The change in the shape of the lever 8 could affect its portion 8*a* or the fulcrum region as well as its portion 8*b*.

We claim:

1. A starter for an internal combustion engine for a motor vehicle, comprising a movable pinion which is adapted to mesh with a gear of the internal combustion engine, a control electromagnet including a core which is movable between a rest position and an actuating position said electromagnetic having an entrainment appendage at its end, a transmission disposed between the core of the electromagnetic and the pinion, the transmission including a rocker lever having a first arm connected to a movable member for moving the pinion and a second arm which is connected, with play, to the entrainment appendage of the core of the electromagnet so that, when the electromagnet is excited, the core leaves its rest position and travels an initial distance without a load before the appendage pivots the lever, and an electric motor which can be supplied so as to rotate the pinion when the movable core of the electromagnet reaches the actuation position and closes an electrical switch, said second arm of the rocker lever having a shaped profile so that, if other geometrical conditions remain the same, the initial loadless travel of the core is shorter than would be the case with a substantially straight lever, and wherein the second arm of the rocker lever is inclined towards the entrainment appendage of the core of the electromagnet.

2. A starter according to claim 1, wherein the second arm of the rocker lever is bent towards the entrainment appendage of the core of the electromagnet.

3. A starter according to claim 1, wherein the second arm of the rocker lever is curved towards the drive appendage of the core of the electromagnet.

* * * * *